United States Patent [19]

Haavie

[11] 3,996,870

[45] Dec. 14, 1976

[54] ARRANGEMENT IN OR RELATING TO A VESSEL FOR PERFORMING DIVING OPERATIONS BY MEANS OF A DIVING BELL

[76] Inventor: Thor Ove Haavie, Incognito Terrasse 1 II, N-Oslo 2, Norway

[22] Filed: Feb. 11, 1975

[21] Appl. No.: 549,030

[30] Foreign Application Priority Data

Feb. 15, 1974 Norway ..... 521/74

[52] U.S. Cl. ..... 114/66; 61/69 R; 114/16 R

[51] Int. Cl.[2] ..... B63B 35/00

[58] Field of Search ..... 114/66, 16 R, 44, 50; 61/69 R, 69 A

[56] References Cited

UNITED STATES PATENTS

| | | | |
|---|---|---|---|
| 962,019 | 6/1910 | Flood et al. | 61/69 A |
| 1,016,808 | 2/1912 | Williamson | 61/69 R |
| 1,694,108 | 12/1928 | Stein | 114/16 R |
| 3,641,961 | 2/1972 | Howard | 61/69 R |

FOREIGN PATENTS OR APPLICATIONS

| | | | |
|---|---|---|---|
| 370,891 | 2/1907 | France | 61/69 R |
| 646,868 | 11/1928 | France | 114/44 |

*Primary Examiner*—Trygve M. Blix
*Assistant Examiner*—Charles E. Frankfort
*Attorney, Agent, or Firm*—Watson, Cole, Grindle & Watson

[57] ABSTRACT

A vessel for performing diving operations by means of a diving bell capable of being raised and lowered from the vessel, includes a docking chamber for the diving bell which is arranged at such a water depth that it will be always positioned below the water level and is surrounded by a dry compartment which is under atmospheric pressure. The docking chamber is in open communication at its bottom with the water and its top portion is provided with coupling means for tight connection to the diving bell when disposed in a water filled space within the docking chamber.

9 Claims, 5 Drawing Figures

ARRANGEMENT IN OR RELATING TO A VESSEL FOR PERFORMING DIVING OPERATIONS BY MEANS OF A DIVING BELL

Drilling for oil on the bottom of the sea has lately been developed to such an extent that it also includes ocean depths where human beings cannot stay without using special equipment like diving bells, submarines, pressure resistant working and dwelling chambers etc.

Deep diving mainly takes place using diving bells which are lowered from fixed platforms, surface diving vessels or the like. The diving bells are equipped for, if necessary, bringing divers and equipment down to very great depths for underwater work. The bells may be used as inspection and maintenance bases and may also transfer personnel to well heads, habitats or the like for performance of maintenance, installation and disassembly work at these locations, furthermore inspection of traces for the installation of pipe lines, inspection of existing pipe lines and installation of pipe lines etc. Using the present technical aids it is possible for a diver to work at depths down to about 250 m. The transportation of divers down to and up from this depth takes place by means of diving bells. Diving without diving bells are normally not down to greater depths than 60–70 m.

Underwater work in calm sea areas and close to shore do not cause any great problems. However, discovery of oil sources in increasingly greater distances from the coast and on greater depths is increasing the requirements for better equipment. The oil production in the North Sea area shows for instance, that with the strongly varying sea and wind conditions, the hitherto used equipment to be unsatisfactory and partially unusable in open sea areas even under good weather conditions. Underwater work in for instance the North Sea is therefore today merely limited to the summer season, and for the future oil production in this area and other open sea areas it is not acceptable not to be able to perform necessary repairs, inspections, new installations etc. on a year round basis and at any moment.

Today supply ships, transformed trawlers, fishing boats or similar vessels are used as mother vessels for diving operations. The motion characteristics for these and other previously known mother vessels are not good enough to ensure continuity in underwater work even under moderate weather conditions, and the vessels must often leave the area and seek habor until the weather conditions improve, leading to delays, increased costs and other negative investments. The hitherto known mother vessels are mainly equipped with deck cranes which bring the diving bells out alongside the vessel for lowering, or by the use of movable gallows placed aft and which in a lowered, tilted position bring the bell clear of the vessel before the bell is lowered to the desired depth. Both by lowering of a bell from a vessel to a distance below the surface of the sea and by raising the bell from such an underwater position and taking it on board the vessel, unforeseeable, dangerous situations will easily occur even under moderate wind and wave conditions.

Also, mother vessels for diving operations are known where the ship is equipped with lowering or receiving shafts for a diving bell. Such shafts, however, only have guiding influence on the bell, and the drawbacks stemming from wave action and ship motion are not eliminated.

The roll and heave motions of the vessel brought about by wave action easily sets the bell in pendulum motion in the upper water layer or in the air so that the bell is easily damaged by being banged more or less strongly against the side of the vessel. Wave action influences the bell in the wave area resulting in uncontrollable buoyancy motion brought about by the motion amplitude of the water particles near the surface, and in addition the hoisting wire or hawser is slackened or tightened as the relative motion between bell and vessel changes with no possibility of bringing these undesirable influences under control quickly enough. Therefore, there is a danger of snapping the wire, particularly while the bell is situated in the upper water layer or in the air.

These stresses can subject the diving bells to great damage and can represent considerable risk to the lives of the divers in the bell.

The purpose of the present invention is to avoid some of the mentioned drawbacks and reduce the others to such an extent that diving work of any kind and particularly in open sea areas can be performed even under very difficult weather and sea conditions.

The main idea of the invention is, instead of the usual lowering and taking on board of diving bells from the level of the sea surface, to perform this so far below the sea surface that taking the bell through the water/air boundary layer is completely avoided. The bell is in accordance with the invention at any time before, during and after a completed diving operation surrounded by water having the prevailing hydrostatic pressure of the surroundings. The bell is also docked in this way on a debth where the motion amplitude of the water particles are reduced to a value which is sufficiently low for such an operation even under very bad weather and sea conditions.

Another important feature of the invention is to take advantage of the good motion characteristics shown by the semisubmersible vessels under bad weather and sea conditions.

The invention is not limited to diving bells only but may also be used for any other form of equipment, bodies or submarine vessels which are to be lowered or raised from a vessel and where it is desirable and/or necessary to protect this from wave action or other forces influencing an object which has to pass through the water/air interface.

These and other important features of the invention will be described more closely in the following with reference to the drawings.

Figure 1:
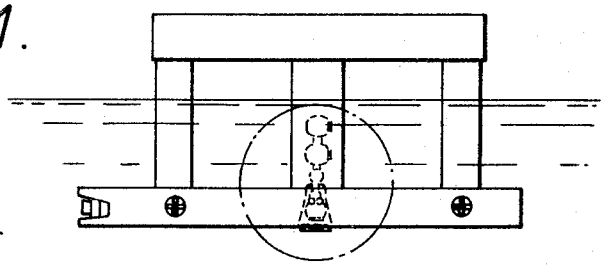
FIG. 1 shows a vessel of the semisubmerisible type having a docking arrangement according to the invention placed in one column.
Figure 5:
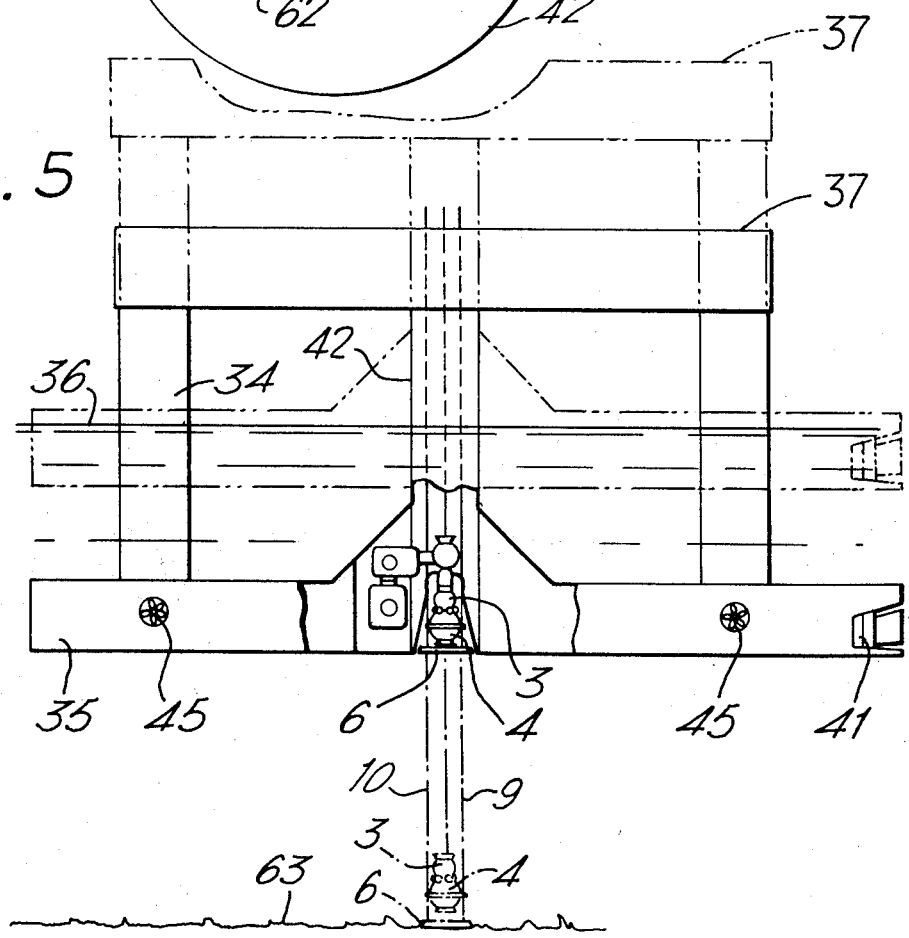
FIG. 5 shows an alternative location of the system.

As is shown in FIGS. 1 and 5 the preferable mother vessel consists of pontoons 35 for the support of columns 34 which carry a deck 37 at suitable height above the sea surface 36, said vessel being equipped with means for filling and emptying of ballast in the pontoons 35 and/or the columns 34 in order to bring the vessel from surface condition, as shown in phanton outline in FIG. 5; down to and/or up from submerged position, as shown in solid outline in FIGS. 1 and 5. The vessel is is equipped with propulsion means 41 in addition to two or more thrusters 45. The vessel can be made of concrete or a combination of concrete and steel or other material, for example pontoons of concrete and columns with deck entirely or partly of steel.

A docking chamber 15 for a diving bell 3, 4 is according to the invention arranged in the middle of the pontoon 35 where the column 42 is arranged in which column is placed a boarding chamber 2 and decompression chambers 1 and 5 in closed relationship with each other and the docking chamber 15.

The column 42 and parts of the pontoon 35 form a closed room 46 around the chambers 1, 2, 5 at atmospheric pressure with open connection to the deck, from which deck the chambers 1, 2, 5 may be lowered down through the column 42 and be placed on top of the docking chamber 15 or elevated up to the deck for inspection or the like.

In the case of an accident where for instance a diver is hurt and must be brought quickly away from the vessel, the diver is placed via the chamber 1 in the decompression chamber 5 or in a emergency chamber on deck (not shown), which then is disconnected while the desired pressure is maintained, whereafter the decompression chamber 5 is hoisted up to the deck for further transportation. Preferably a reserve decompression chamber 5 is now placed in connection with decompression chamber 1, and diving work can continue. The decompression chamber 5 is served by means of separate hoisting wires and winches (not shown) which are independent of similar equipment for the chambers 1 and 2.

The hatches 47 and 48 form in a way known per se a closable connection between the decompression chambers 5 and 1, while the hatches 49 and 50 form a similar connection between the decompression chamber 1 and the boarding chamber 2. The hatch 51 also gives access in a way known per se to the decompression chamber 5 and the hatch 52 to the decompression chamber 1, while the hatch 53 gives access to the boarding chamber 2, all at atmospheric pressure.

Figure 3:
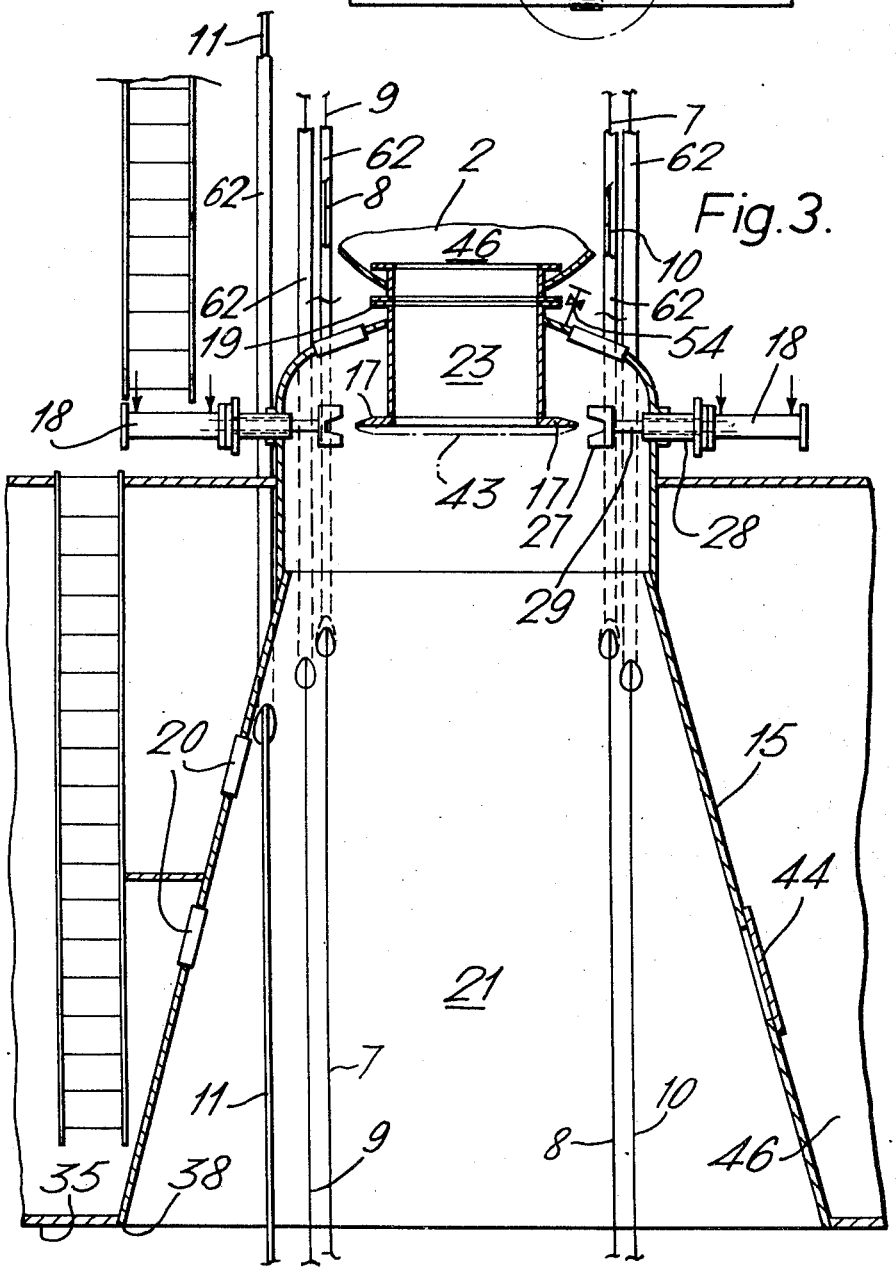
FIG. 3 shows in even larger scale a section through the details of a docking chamber for a diving bell.
Figure 2:
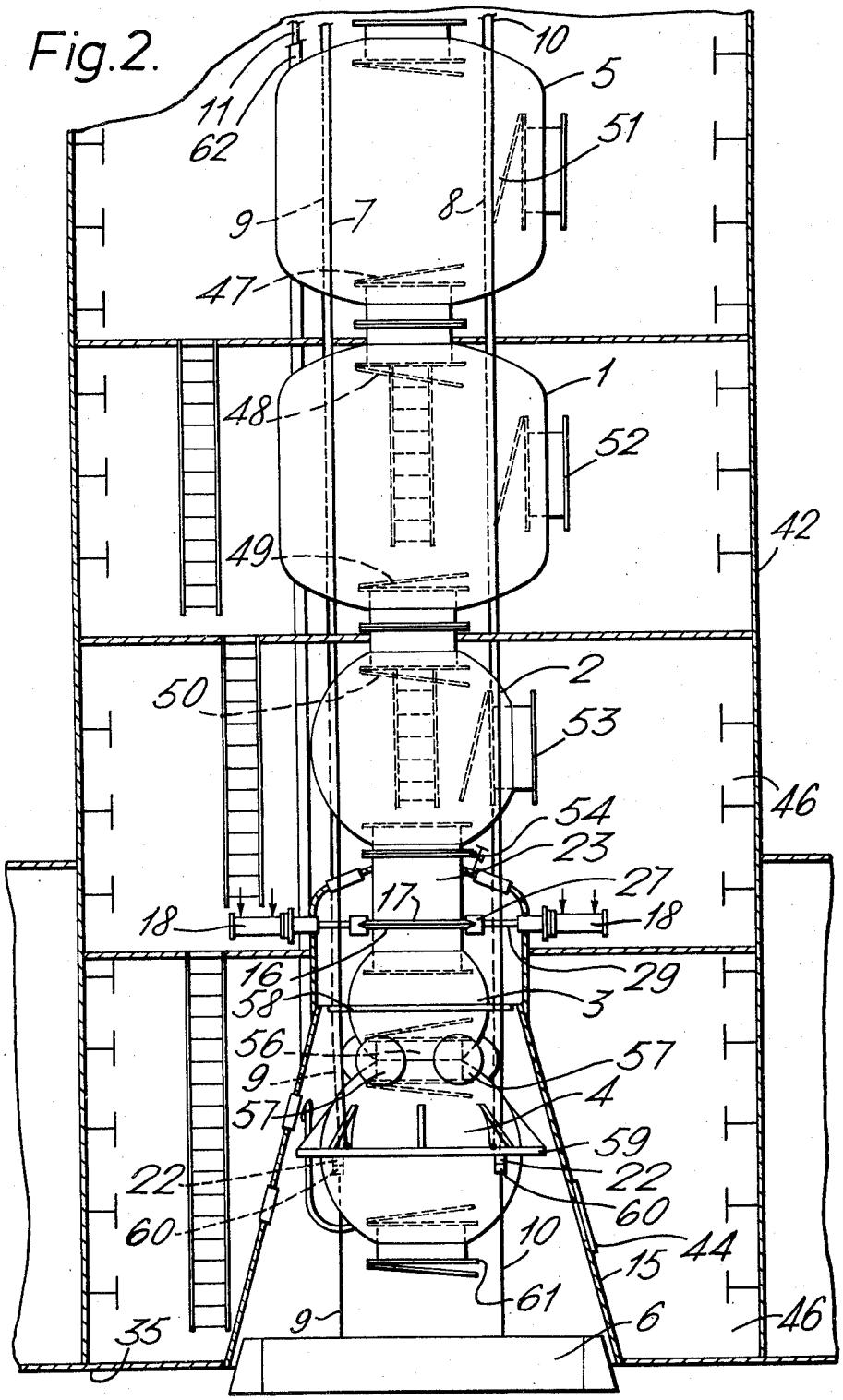
FIG. 2 shows in larger scale a section corresponding to the circled section on FIG. 1.

According to the invention the docking chamber 15 is preferably in the form of a watertight, pressure resistant truncated cone as shown in FIGS. 2 and 3 with the largest opening 38 directed downwardly and in open contact with the surrounding body of water so that the pressure in the docking chamber at any time corresponds to the prevailing hydrostatic pressure. Any air that may have collected in the upper part is led out through the valve 54 so that the docking chamber at all times is completely filled with water.

As mentioned previously, the vessel and thereby the pontoons are lowered to a depth where the amplitude of the water particles are greatly reduced in the water area where the docking operation is to be performed. The amplitude of the water paticles becomes further reduced in the inside 21 of the docking chamber filled with water. Thus, lowering or raising of or docking of the diving bells 3, 4 which are fixedly attached to each other practically takes place in calm water. Motion of the vessel, for instance heave, is reduced to a level where they only to a small extent effect or hinder these operations due to the construction of the vessel and the draft of the pontoons.

According to the invention the upper section of the docking chamber 15 terminates in a side wall 23 consisting of a cylindrical section being fixedly attached to the chamber 15.

As the top of the side wall a flange 19 is arranged for coupling to the boarding chamber 2, and at the lower edge a flange 17 is arranged for coupling to the diving bell. Level with the flange 17 there is, in a way known per se, arranged a preferably hydraulic coupling arrangement 18 with pistons 49 which in sealing relationship 28 extend through the wall of the docking chamber 15. Inside the chamber 15 the pistons carry claw-like coupling means 27 having inclined faces co-operating with corresponding inclined faces of a flange 16 of the diving bell 3 and a inclined flange 17 of the side wall 23. Axial displacement of the pistons 29 press the two flanges against each other to form a tight connection. Connecting means 18, 29, 28, 27 are arranged in suitable mutual distance in a number of 2–6 around the periphery of the docking chamber 15.

The docking chamber 15 is furthermore equipped with a greater number of inspection glasses 20 and an access hatch 44. At the top of the chamber there is arranged an air release valve 54.

Hoisting and guiding wires to be described more closely in the following are run internally in separate tubes 62 for the respective wires into the docking chamber 15. The tubes 62 are fixedly and tightly connected with the walls of the chamber 15, and according to the invention each separate tube extends continuously from these up to a level above the largest draft, preferably up to deck level. Thus, the tubes form an open connection for the wires into the docking chamber 15 and thereby eliminate the sealing problems which otherwise would occur by running the from a room filled with air to a room filled with water.

The diving bells 3, 4 are interconnected in a way known per se, the bell 3 being a ballast bell and the bell 4 being the dwelling place for divers during the lowering and raising faces. Around the connecting nozzle 56 gas containers 57 for emergency supply are arranged in a way known per se.

The introduction of a supply cable 11 is done via a tube from deck level the same way the wires were introduced into the inside of the docking chamber. The supply cable supplies the diving bell 4 in a way known per se with breathing gases, electrical energy, telephone and television cables etc.

According to the invention, a circular frame 58 is arranged around the outer periphery of the diving bell and has a form and diameter approximately corresponding to the diameter at that level of the diving bell in connecting position. The purpose of the frame 58 is to center the diving bell 3 for correct connection.

Around the equator of the diving bell 4 a guide ring 59 is arranged in a way known per se, to which ring the hoisting wires 7, 8 are attached. Guide holes for guide wires 9, 10 are arranged in the guide ring. At the bottom side of the guide ring 59 stoppers 22 are arranged near the guide holes for the guide wires 9, 10. The purpose of these stoppers is to co-operate with corresponding stoppers 60 on the guide wires placed in predetermined positions on these in order to determine the maximum hoisting position of the base plate 6 of the diving bell when it is hoisted into the docking chamber 15. In addition, maximum lowering of the diving bells 3, 4 toward the base plate when it is resting on the sea floor 63 may thereby be determined.

In the example the wires are shown attached to a base plate of known design. By the use of a diving bell for operations on a depth where the divers cannot leave the diving bell due to the prevailing hydrostatic pressure and instead are to be transferred to a body of any kind resting on the sea floor, the guide wires will preferably be fixed to this body in such a way that the stoppers contact each other when the coupling arrangement 61 of the diving bell 4 are in close proximity to a corresponding coupling arrangement on the body.

During submerging trails of the vessel without installed chambers and bells, the side wall 23 which forms an open connection between the water-filled room 21 and the room 46 may temporarily be closed by means of a blind 43 as suggested in FIG. 3 under the action of 27.

Figure 4:
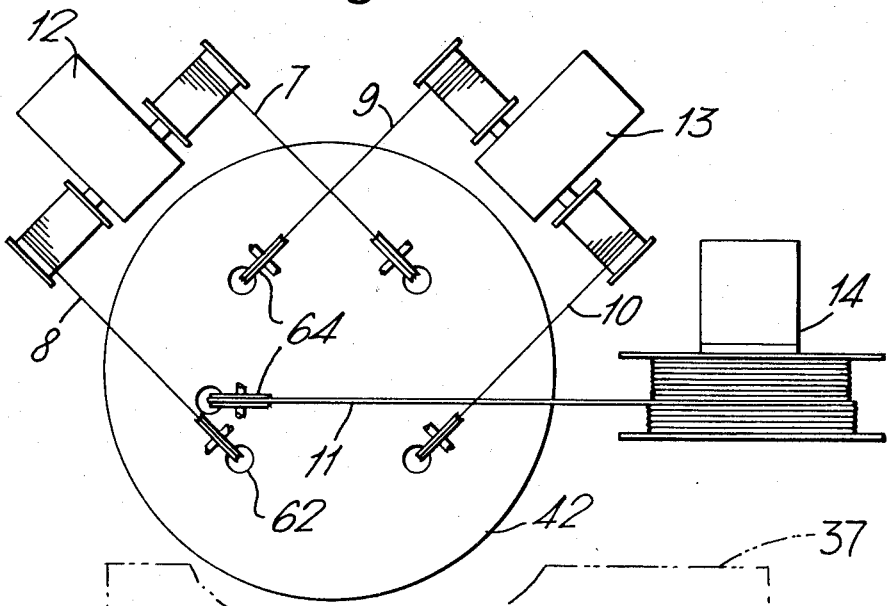
FIG. 4 shows schematicly top view of the arrangement of winches for the system according to the invention.

FIG. 4 indicates how the respective winches for maneuvering the diving equipment preferably are arranged. The hoisting winch 12 with hoisting wires 7, 8 is thus arranged 90° with respect to the winch 13 for the diving wires 9, 10, while the drum 14 for the supply cable 11 is arranged near the winch 13. All the wires and the supply cable 11 is guided down into the column 42 over the guide wheels 64.

The invention may be modified in several ways within its frame. Thus, other forms of docking chambers than that having form of a truncated cone may be used. Furthermore, two or more such chambers with auxilliary equipment may find place in one and the same vessel.

I claim:

1. An arrangement in or relating to a vessel for performing diving operations by means of a diving bell which may be lowered and raised from a working position from the vessel by means of wires or the like, characterized in that the vessel comprises a docking chamber for the diving bell, said chamber being arranged at such a depth that it always will be positioned below the water level and be entirely filled with water, said chamber being surrounded by a dry compartment which is under atmospheric pressure, said docking chamber at the bottom thereof being in open communication with the sea so as to define a water filled space, and the top of said docking chamber being closed and having coupling means for tight connection to the diving bell when disposed in the water filled space within the docking chamber, said docking chamber having a peripheral wall thereon with a flange which mates with a flange on said diving bell, said coupling means cooperating with the flanges for coupling them together.

2. The arrangement according to claim 1, wherein a blind flange is provided which is capable of being secured to one of the aforementioned flanges.

3. The arrangement according to claim 1, wherein said docking chamber is conical in shape with the largest opening thereof facing downwardly toward the open sea.

4. An arrangement in or relating to a vessel for performing diving operations by means of a diving bell which may be lowered and raised from a working position from the vessel by means of wires or the like, characterized in that the vessel comprises a docking chamber for the diving bell, said chamber being arranged at such a depth that it always will be positioned below the water level and be entirely filled with water, said chamber being surrounded by a dry compartment which is under atmospheric pressure, said docking chamber at the bottom thereof being in open communicatiion with the sea so as to define a water filled space, and the top of said docking chamber being closed and having coupling means for tight connection to the diving bell when disposed in the water filled space within the docking chamber, and an air release valve being arranged in said closed top of said docking chamber.

5. An arrangement in or relating to a vessel for performing diving operations by means of a diving bell which may be lowered and raised from a working position from the vessel by means of wires or the like, characterized in that the vessel comprises a docking chamber for the diving bell, said chamber being arranged at such a depth that it always will be positioned below the water level and be entirely filled with water, said chamber being surrounded by a dry compartment which is under atmospheric pressure, said docking chamber at the bottom thereof being in open communication with the sea so as to define a water filled space, the top of said docking chamber being closed and having coupling means for tight connection to the diving bell when disposed in the water filled space within said docking chamber, a platform being provided for lying above the water level and having pontoons lying below the water level, columns interconnecting said platform with said pontoons, said bottom of said chamber being connected with said pontoons, tubes tightly connected with said chamber and extending therefrom to above the lowest draft of the vessel up to said platform, the lifting wires and a connecting cable extending through said tubes for raising and lowering the chamber.

6. An arrangement in or relating to a vessel for performing diving operations by means of a diving bell which may be lowered and raised from a working position from the vessel by means of wires or the like, characterized in that the vessel comprises a docking chamber for the diving bell, said chamber being arranged at such a depth that it always will be positioned below the water level and be entirely filled with water, said chamber being surrounded by a dry compartment which is under atmospheric pressure, said docking chamber at the bottom thereof being in open communication with the sea so as to define a water filled space, a movable base plate provided for tightly closing the bottom of said docking chamber, and the top of said docking chamber being closed and having coupling means for tight connection to the diving bell when disposed in the water filled space within the docking chamber.

7. An arrangement in or relating to a vessel for performing diving operations by means of a diving bell which may be lowered and raised from a working position from the vessel by means of wires or the like, characterized in that the vessel comprises a docking chamber for the diving bell, said chamber being arranged at such depth that it always will be positioned below the water level and be entirely filled with water, said chamber being surrounded by a dry compartment which is under atmospheric pressure, said docking chamber at the bottom thereof being in open communication with the sea so as to define a water filled space, the top of the docking chamber being closed and having coupling means for tight connection to the diving bell when disposed in the water filled spaced within the docking chamber, a platform being provided for lying above the water level and having pontoons lying below the water level, columns interconnecting said platform with said pontoons, said bottom of said chamber being connected with said pontoons, and one of said columns being provided in open communication with said platform, the dry compartment being defined by said one column.

8. The arrangement according to claim 7, wherein winches are provided on said platform for raising and lowering the wires.

9. An arrangement in or relating to a vessel for performing diving operations by means of a diving bell which may be lowered and raised from a working position from the vessel by means of wires or the like, characterized in that the vessel comprises a docking chamber for the diving bell, a circular centering frame being disposed about the outer periphery of the diving bell, said chamber being arranged at such depth that it always will be positioned below the water level and be entirely filled with water, said chamber being surrounded by a dry compartment which is under atmospheric pressure, said docking chamber at the bottom thereof being in open communication with the sea so as to define a water filled space, and the top of said docking chamber being closed and having a coupling means for tight connection to the diving bell when disposed in the water filled spaced within the docking chamber.

* * * * *